US010117456B2

(12) United States Patent
Couderc et al.

(10) Patent No.: US 10,117,456 B2
(45) Date of Patent: Nov. 6, 2018

(54) ACTIVATED CARBON FOR SMOKING ARTICLES

(71) Applicant: PHILIP MORRIS PRODUCTS, S.A., Neuchatel (CH)

(72) Inventors: Gaetan Couderc, Peseux (CH); Ping Li, Lausanne (CH); Roger Hofer, Peseux (CH)

(73) Assignee: Philip Morris Products S.A. (CH)

( * ) Notice: Subject to any disclaimer, the term of this patent is extended or adjusted under 35 U.S.C. 154(b) by 119 days.

(21) Appl. No.: 15/107,559

(22) PCT Filed: Dec. 23, 2014

(86) PCT No.: PCT/US2014/072058

§ 371 (c)(1),
(2) Date: Jun. 23, 2016

(87) PCT Pub. No.: WO2015/103021

PCT Pub. Date: Jul. 9, 2015

(65) Prior Publication Data

US 2016/0316815 A1 Nov. 3, 2016

Related U.S. Application Data

(60) Provisional application No. 61/921,657, filed on Dec. 30, 2013.

(30) Foreign Application Priority Data

Dec. 30, 2013 (EP) ..... 13199782

(51) Int. Cl.
*A24D 3/16* (2006.01)
*A24D 1/04* (2006.01)
*A24D 3/02* (2006.01)

(52) U.S. Cl.
CPC ..... *A24D 3/163* (2013.01); *A24D 1/045* (2013.01); *A24D 3/0204* (2013.01); *A24D 3/0237* (2013.01)

(58) Field of Classification Search
None
See application file for complete search history.

(56) References Cited

U.S. PATENT DOCUMENTS 1,968,847 A * 8/1934 Morrell ..... C01B 32/336 210/504
3,351,071 A 11/1967 Belfort
3,864,277 A 2/1975 Kovach
3,901,823 A * 8/1975 Dimitri ..... C01B 32/384 23/314
5,162,286 A * 11/1992 MacDowall ..... C01B 32/348 502/423
5,538,932 A 7/1996 Yan et al.
8,759,253 B2 * 6/2014 De Leede ..... B01D 53/02 502/424
2011/0005534 A1 * 1/2011 Albino ..... A24B 13/00 131/270
2011/0123474 A1 * 5/2011 Jenkins ..... A61L 9/014 424/76.6

FOREIGN PATENT DOCUMENTS

WO WO 03/059096 A1 7/2003
WO WO 2006/070291 A2 7/2006
WO WO 2008/142420 A1 11/2008
WO WO 2009/011590 A1 1/2009
WO WO 2009/045860 A2 4/2009
WO WO 2012/047346 A1 4/2012

OTHER PUBLICATIONS

Maciá-Agulló et al, "Activation of coal tar pitch carbon fibres: Physical activation vs. chemical activation", Carbon 42 (2004) 1367-1370. (Year: 2004).*
International Preliminary Report on Patentability, issued by the International Bureau of WIPO for PCT/US2014/072058 dated Jul. 14, 2016, 8 pgs.
International Search Report and Written Opinion issued by the European Patent Office for PCT/US2014/072058 dated Apr. 15, 2015, 11 pgs.
European Search Report issued by the European Patent Office for EP Application No. 13199782, dated Jun. 11, 2014.
Gregg and Sing, *Adsorption, Surface Science and Porosity*, Second Edition, Academic Press, New York, NY; 1982. Cover page, title page and table of contents: 5 pgs.
Linares-Solano et al., "Further advances in the characterization of Microporous carbons by Physical Adsorption of Gases," *Tanso*; 1998;185:316-325.
Rouquerol et al., *Adsorption by powders and porous solids. Principles, Methodology and applications*, Academic Press, Elsevier Ltd, 1999.Cover page, title page and table of contents: 11 pgs.

* cited by examiner

*Primary Examiner* — Dennis R Cordray
(74) *Attorney, Agent, or Firm* — Mueting, Raasch & Gebhardt, P.A.

(57) ABSTRACT

A smoking article includes a smokable material and a filter downstream of the smokable material. The filter includes activated carbon material having a BET of between 1000 and 2000 $m^2/g$ and exhibiting less particle breakthrough than granulated coconut shell derived activated carbon currently used for filters of smoking articles.

14 Claims, 5 Drawing Sheets

GCN REF

GCN EXTRA

WOOD

WOOD EXTRUDED

OLIVE STONE

ACTIVATED CARBON FOR SMOKING ARTICLES

This application is the § 371 U.S. National Stage of International Application No. PCT/US2014/072058, filed 23 Dec. 2014, which claims the benefit of U.S. Provisional Application No. 61/921,657, filed 30 Dec. 2013 and European Application No. 13199782.7, filed 30 Dec. 2013, each of which are incorporated by reference herein in their entireties.

This disclosure relates to activated carbon suitable for smoking articles, to filters containing such activated carbon, and related smoking articles.

Combustible smoking articles, such as cigarettes, typically have shredded tobacco (usually in cut filler form) surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. The filter is positioned to entrap some constituents of mainstream smoke before the mainstream smoke is delivered to a smoker and may contain activated carbon for adsorbing smoke constituents.

Filters containing activated carbon tend to suffer from particle breakthrough, which occurs when particles of activated carbon are released from the filter and enter the smoker's mouth as a smoker draws on the mouth end of a smoking article. Activated carbon for use in filters of smoking articles is typically derived from coconut shells, which can be activated to varying degrees to control adsorption efficiency. More highly activated carbon is generally more efficient than less highly activated carbon. However, resistance to attrition decreases, and higher amounts of particle breakthrough can result when coconut shell-derived activated carbon is activated to a higher degree. In addition, coconut shell-derived activated carbon that is activated to a high degree may generate a substantial amount of dust during the filter making process, which can contaminate filter making machinery.

Despite suffering from particle breakthrough and dusting, activated carbon derived from coconut shells tends to be harder and tends to have a greater resistance to attrition than activated carbon derived from other vegetal sources. Yet it may be advantageous to employ sources of activated carbon other than coconut shells in order to further improve the properties of the activated carbon and because coconut shells are a limited resource.

A number of processes have been suggested to increase hardness of activated carbon. Such processes include coating activated carbon particles with a polymer and modifying the surface of the particles. However, such processes may lead to a loss of adsorption efficiency. Activated carbon made from certain polymers may be less fragile than activated carbon made from vegetal sources, but in many cases is so hard or abrasive that it can damage industrial manufacturing equipment.

One object of the present invention is to employ a source of activated carbon other than coconut shells for use in smoking article filters.

Another object of the present invention is to include activated carbon into a smoking article, where the activated carbon exhibits less particle breakthrough during smoking than coconut shell-derived activated carbon currently employed in smoking article filters, while having an adsorption efficiency similar to or greater than coconut shell-derived activated carbon currently employed in smoking article filters.

Another object of the present invention is to include activated carbon in a smoking article, where the activated carbon exhibits less dusting during manufacturing than coconut shell-derived activated carbon currently employed in smoking article filters.

Other objects of the present invention will be evident to those of skill in the art upon reading and understanding the present disclosure, which includes the claims that follow and accompanying drawings.

In aspects of the present invention, a smoking article includes a smokable material and a filter downstream of the smokable material. The filter includes activated carbon formed from a process that includes carbonizing a composition comprising a cellulosic material and an added activatable binder. Preferably, the binder comprises lignin. In aspects of the present invention, activated carbon material formed from a composition comprising cellulosic material and an activatable binder is used in the manufacture of a filter for a smoking article.

In aspects of the present invention, a method for manufacturing a filter for a smoking article, or a smoking article having a filter, includes providing activated carbon material formed from a process that includes carbonizing a composition comprising cellulosic material and an added activatable binder; providing filter material for use in a smoking article; and combining the activated carbon material and the filter material to form a filter for a smoking article. The filter may be incorporated into a smoking article.

In aspects of the present invention, a smoking article includes a smokable material and a filter downstream of the smokable material. The filter includes activated carbon material having a BET of between about 1000 and 2000 $m^2/g$, a ball-pan hardness of greater than about 95%, and exhibits less particle breakthrough than a coconut shell-derived activated carbon activated to the same degree. Particle breakthrough analysis may be performed in an article having a filter in a standard plug-space-plug configuration in which the coconut shell-derived activated carbon exhibits at least some particle breakthrough.

"Activated to the same degree" means the coconut shell-derived activated carbon has a BET within 10% of the activated carbon used in or as the filter. "BET" is the total surface area of a solid calculated by the Brunauer, Emmet, Teller equation, as further described in the Examples below.

Various aspects of the filters and smoking articles of the present invention may have one or more advantages relative to currently available filter and smoking articles. For example, use of activated carbon derived from a source other than coconut shells may be advantageously used if supplies of coconut shells decrease. By way of further example, embodiments of activated carbon described herein may result in decreased dusting during manufacturing and decreased particle breakthrough during smoking, relative to coconut shell-derived activated carbon typically employed in filters for smoking articles. In some embodiments, the efficiency of activated carbon may be enhanced relative to coconut shell-derived activated carbon typically employed in filters for smoking articles, while maintaining desired low levels of dusting and particle breakthrough. Additional advantages of one or more aspects of filters and smoking articles described herein will be evident to those of skill in the art upon reading and understanding the present disclosure.

Activated carbon is a generic term used to describe a family of carbonaceous adsorbents with an extensively developed internal pore structure. Activated carbon can be produced from a carbonaceous source material such as wood, lignite, coal, coconut husk or shells, peat, pitch, polymers, cellulose fibers, polymer fibers, or the like. Activated carbon may be produced by any suitable process such as physical activation or chemical activation. In physical activation, the source material is developed into activated carbon using hot gases by carbonization, activation/oxidization or carbonization and activation/oxidization. The process of carbonization includes pyrolyzing source material at high temperatures, typically in the range of about 600° C. to about 900° C., in the absence of oxygen. Activation/oxidization includes exposing carbonized material to oxidizing atmospheres, such as steam, carbon dioxide or oxygen, at temperatures above 250° C. Temperatures for activation/oxidization typically range from about 600° C. to about 1200° C.

Chemical activation includes impregnating raw source material with certain chemicals, such as an acid, base or salt, such as phosphoric acid, potassium hydroxide, sodium hydroxide, calcium chloride, or zinc chloride. The raw materials are then carbonized at temperatures that are typically lower than physical activation carbonization. For example, temperatures for chemical activation carbonization may be in the range of from about 450° C. to about 900° C. Carbonization and activation may occur simultaneously.

For purposes of the present disclosure, carbonaceous source material may be activated via any suitable process. For example, the activation process can comprise chemical activation, which may include shorter activation times and lower temperatures relative to physical activation. Alternatively, physical activation may be employed.

In preferred embodiments, activated carbon is formed from a composition that includes cellulosic material and an activatable binder. As used herein, "activatable binder" means a binder that can be treated or processed to become activated carbon. Thus, the activatable binder together with the cellulosic material may be activated to form activated carbon. Any suitable activatable binder may be used. Preferably, the activatable binder comprises, consists essentially of, or consists of lignin. As used herein, "lignin" includes lignin as it exists in nature or derivative forms of lignin that result from extraction of lignin from source material, such as lignophenol, lignin-aminophenol, and lignosulphonate.

Any suitable cellulosic material may be used in combination with an activatable binder to produce activated carbon. Preferably, the cellulosic material comprises raw vegetal material. Examples of suitable raw vegetal material include coconut husk, coconut shell, olive stone, wood, cellulose fibers, and the like. Examples of wood that may be used include hardwood, softwood and scrap wood. In embodiments, a combination of cellulosic material is used to produce activated carbon. Preferably, the combination of cellulosic materials includes wood, such as wood particles, and a vegetal material, such as shells or kernels. The weight ratio of wood to vegetal material may be any suitable ratio, such as between 10:90 and 90:10.

A composition for activation may include any suitable amount of cellulosic and activatable binder. Preferably, the cellulosic material is present in the composition in an amount of about 50% or greater. Generally, the cellulosic material will be present in a composition for activation in an amount less than about 99%. More preferably, the cellulosic material is present in a composition to be activated in an amount from about 65% by weight to about 95% by weight.

Preferably, the activatable binder is present in the composition in an amount of about 2% by weight or greater. More preferably, the activatable binder is present in the composition in an amount of about 5% by weight or greater. Generally, the activatable binder will be present in a composition for activation in an amount less than 50% by weight. Preferably, the activatable binder is present in a composition for activation in an amount up to about 35% by weight. More preferably, a composition to be activated will have from about 5% by weight to about 35% by weight activatable binder.

If the composition for activation is to be chemically activated, a chemically activatable composition may be formed by adding one or more chemical activation agent, such as an acid, base or salt, to the composition comprising cellulosic material and activatable binder. Examples of specific chemical activation agents include phosphoric acid, potassium hydroxide, sodium hydroxide, calcium chloride, and zinc chloride. The chemical activation agent is preferably present in an amount sufficient to facilitate chemical activation of the cellulosic material and the activatable binder. In embodiments the one or more chemical activation agent comprises from about 25% by weight to about 75% by weight of the chemically activatable composition.

Preferably, a composition comprising cellulosic material and activatable binder, whether or not the composition is a chemically activatable composition, is extruded prior to activation. The composition may be extruded as a pellet of any suitable size or shape. Preferably, the composition is extruded into generally cylindrical pellets. The cylindrical pellets may have any suitable dimensions. Preferably, the cylindrical pellets have a diameter from about 0.5 mm to about 1 mm. Preferably, the cylindrical pellets have lengths of about 0.5 mm to about 10 mm. More preferably, the cylindrical pellets have lengths of about 1 mm to about 5 mm.

By way of example, extrusion and chemical activation may be performed generally as described in WO 2009/011590, entitled CHEMICALLY ACTIVATED CARBON AND METHODS FOR PREPARING THE SAME.

Preferably, the activated carbon is not modified following activation. For example, no coatings or other material that may leave a substantial residue are disposed on the activated carbon after activation.

The activated carbon of the present invention preferably exhibits less particle breakthrough or dusting than coconut shell-derived activated carbon that is currently used in filters for smoking articles. Currently employed coconut shell-derived activated carbon typically is granular activated carbon having a mesh size of 30-70 (US) and a BET of about 1100 $m^2/g$. As shown in the Examples below, reference coconut shell-derived activated carbon has a density of about 0.49 $g/cm^3$ and a ball pan hardness of about 98%.

The activated carbon used in filters of the present invention exhibit less particle breakthrough or dusting than coconut shell-derived activated carbon that is activated to the same degree as the activated carbon used in filters of the present invention. For reference, coconut shell-derived activated carbon for comparison to activated carbon of the present invention can be the same as standard activated carbon, but with a different level of activation to match the activation level of the activated carbon of the present invention. For example, the same source material that is used to make coconut shell-derived activated carbon currently used in smoking article filters may be activated at a different temperature or time than coconut shell-derived activated carbon having a BET of 1100 $m^2/g$ but is otherwise activated using the same process as coconut shell-derived activated carbon currently used in smoking article filters.

Particle breakthrough can be determined by any suitable process. Preferably, particle breakthrough is measured via dry puff (unlit) analysis on a filter containing activated carbon. Particle breakthrough is analyzed when the filter (optionally incorporated into a smoking article) is operably coupled to a smoking machine equipped with a particle counter configured to detect particles in the size range from about 0.3 μm to about 10 μm. Preferably the particle counter is a laser light scattering particle counter, such as AEROTRAK® particle counter. The smoking machine is preferably configured to take 12 puffs of 55 mL during 2 seconds every 13 seconds per filter (optionally incorporated into a smoking article). Preferably, particle breakthrough results are averaged from tests of a number of filters or smoking articles, such as five or ten or more filters or smoking articles.

Particle breakthrough analysis of activated carbon of a filter of the present invention may be compared to reference coconut shell-derived activated carbon in the following manner. The reference coconut shell-derived activated carbon and the activated carbon of the present invention is incorporated into test articles, such as test filters or articles comprising test filters, that are substantially the same. For example, the test article having reference coconut shell-derived activated carbon preferably has the same amount of activated carbon (the weight of the carbon in the two test articles is within 5% of one another). The reference activated carbon is incorporated into the test article in substantially the same manner as the activated carbon of the present invention is incorporated into a corresponding test article. The test articles have a plug-space-plug configuration, with the carbon added to the space in the filter.

Preferably, the activated carbon of the present invention exhibits a particle breakthrough of about 500 counts or less when tested by a method that produces about 580 counts for reference coconut shell-derived activated carbon. More preferably, the activated carbon of the present invention exhibits a particle breakthrough of about 400 counts or less when tested by a method that produces about 580 counts for reference coconut shell-derived activated carbon. Even more preferably, the activated carbon of the present invention exhibits a particle breakthrough of about 250 counts or less when tested by a method that produces about 580 counts for reference coconut shell-derived activated carbon.

The length, amount, density or composition of filter material, such as cellulose acetate tow, in a test article may be varied to affect the particle breakthrough of the reference coconut shell-derived activated carbon. Once the desired particle breakthrough is achieved in the reference test article, the activated carbon of the present invention may be tested in a substantially identical test article to determine whether particle breakthrough of the activated carbon of the present invention is reduced relative to particle breakthrough of the reference coconut shell-derived activated carbon.

To test whether a filter or smoking article has activated carbon of the present invention, activated carbon may be removed from the filter or smoking article and placed in a test article. Preferably, the test article is one that produces a particle breakthrough of about 580 with reference coconut shell-derived activated carbon. Activated carbon may be removed from a filter or smoking article in any suitable manner. For example, if the filter is a plug-space-plug filter, activated carbon may be physically removed from the filter. By way of further example, if the filter is a cellulose acetate carbon-on-tow filter, the filter material may be dissolved, for example in acetone, leaving activated carbon which may be dried and incorporated into a test article.

Any decrease in particle breakthrough relative to filters having coconut shell-derived activated carbon currently employed in smoking articles (30-70 mesh US, 1100 $m^2/g$ BET) is considered desirable.

When compared to filters having a reference activated carbon activated to the same degree as activated carbon of filters of the present invention, the filters of the present invention preferably exhibit 10% or more reduction in particle breakthrough. More preferably, the filters of the present invention preferably exhibit 50% or more reduction in particle breakthrough compared to filters having reference activated carbon activated to the same degree. Even more preferably, the filters of the present invention exhibit 90% or more reduction in particle breakthrough compared to filters having reference activated carbon activated to the same degree.

Activated carbon for use in filters of smoking articles of the present invention may have any suitable BET. Preferably, activated carbon for use in filters of smoking articles of the present invention has a BET from about 1000 $m^2/g$ to about 2000 $m^2/g$. More preferably, activated carbon for use in filters of smoking articles of the present invention has a BET from about 1200 $m^2/g$ to about 1800 $m^2/g$. Even more preferably, activated carbon for use in filters of smoking articles of the present invention has a BET from about 1400 $m^2/g$ to about 1600 $m^2/g$. For example, preferred activated carbon for use in filters of smoking articles of the present invention may have a BET of about 1500 $m^2/g$.

Activated carbon for use in filters or smoking articles of the present invention may have any suitable hardness. Preferably the activated carbon is not so hard that it damages filter making equipment or smoking article making equipment. One measure that may be employed to characterize hardness is ball pan hardness. Ball pan hardness may be measured following ASTM D3802-10. The inventors have found that ball-pan hardness may give an idea of how resistant activated carbon is to particle degradation, with activated carbon having greater ball-pan hardness tending to have increased resistance to attrition. Ball pan hardness is a widely used metric for establishing a measurable characteristic of an activated carbon that is related to dusting. In embodiments, activated carbon for use in filters or smoking articles of the present invention has a ball pan hardness of about 95% or greater. Preferably, activated carbon for use in filters or smoking articles of the present invention has a ball pan hardness of about 97% or greater or 98% or greater. More preferably, activated carbon for use in filters or smoking articles of the present invention has a ball pan hardness of about 99%. It will be understood that activated carbon for use in filters or smoking articles of the present invention will generally have a ball pan hardness of less than 100%.

Activated carbon for use in filters or smoking articles of the present invention may have any suitable density as determined by ASTM D-2854-09. Preferably, activated carbon for use in filters of smoking articles of the present invention has a density from about 0.35 $g/cm^3$ to about 0.65 $g/cm^3$. More preferably, activated carbon for use in filters of smoking articles of the present invention has a density from about 0.4 $g/cm^3$ to about 0.60 $g/cm^3$. For example, preferred activated carbon for use in filters of smoking articles of the present invention may have a density of about 0.42 $g/cm^3$.

Activated carbon for use in filters of the present invention preferably has two or more of a preferred particle breakthrough property, a preferred BET property, a preferred hardness property, and a preferred density property described above. Preferably, activated carbon for use in filters of the present invention has at least a preferred particle breakthrough property described above and a preferred BET property described above. More preferably, activated carbon for use in filters of the present invention has three of more of the preferred properties described above. For example, activated carbon for use in filters of the present invention has a preferred particle breakthrough property described above, a preferred BET property described above, and a preferred hardness property described above. Even more preferably, activated carbon for use in filters of the present invention has all four of a preferred particle breakthrough property, a preferred density property, a preferred hardness property, and a preferred BET property described above.

Activated carbon may be placed in a filter for a smoking article in any suitable manner. For example, activated carbon can be intermingled with fibrous filter material, placed in a void space in the filter, or in a combination intermingled with fibrous filter material and in a void space in the filter.

In embodiments, activated carbon is provided in a filter in a plug-space-plug configuration, where the activated carbon is present in a void space between two sections of filter plug material. Preferably, the plugs of filter sections in a plug-space-plug filter configuration are plugs of cellulose acetate tow. In embodiments, activated carbon is provided in a carbon on tow configuration. Preferably, the tow is cellulose acetate tow. Regardless of the filter configuration, it may be desirable to include a white cellulose acetate tow section at the mouth end of the filter for purposes of aesthetics or to meet consumer expectations.

Any suitable smoking article may include a filter having activated carbon as described in this disclosure, where the filter is disposed downstream of a smokable material. The term "smoking article" includes cigarettes, cigars, cigarillos and other articles in which a smokable material, such as a tobacco, is lit and combusted to produce smoke. The term "smoking article" also includes articles in which smokable material is not combusted, such as but not limited to smoking articles that heat a smoking composition directly or indirectly, or smoking articles that use air flow or a chemical reaction, with or without a heat source, to deliver nicotine or other materials from the smokable material.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Figure 1:
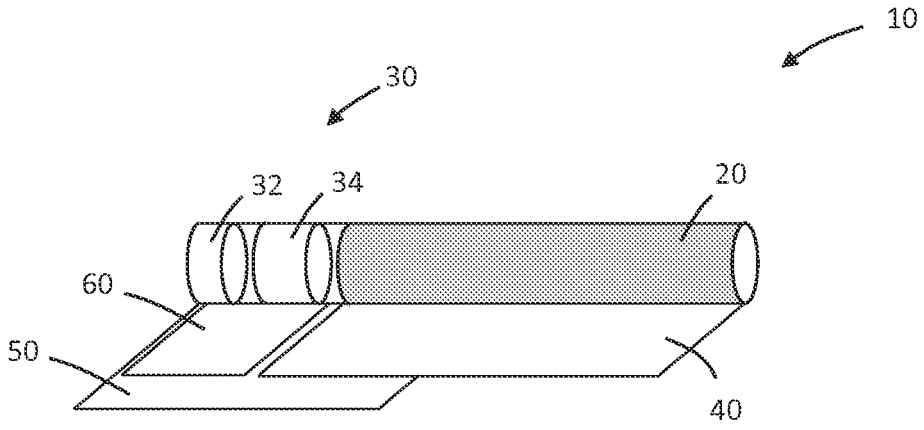
FIG. 1 is a schematic perspective views of an embodiment of a partially unrolled smoking article.
Figure 2:
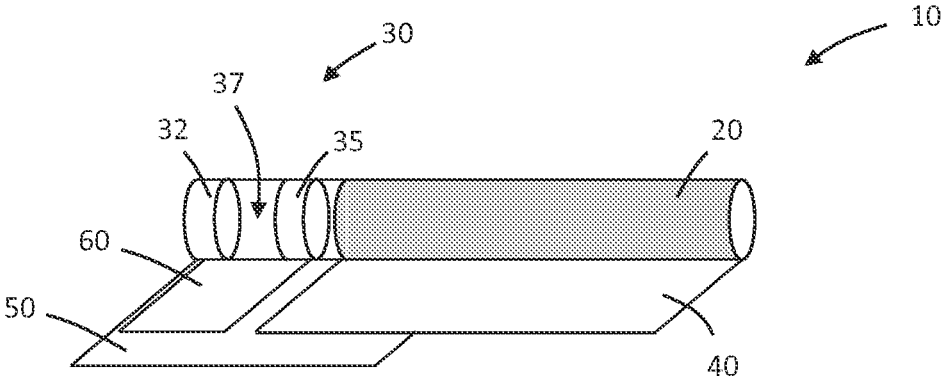
FIG. 2 is a schematic perspective views of an embodiment of a partially unrolled smoking article.

FIGS. 1-2 are schematic perspective views of embodiments of partially unrolled smoking articles. The smoking articles depicted in FIGS. 1-2 illustrate embodiments of smoking articles or components of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

Referring now to FIG. 1, a smoking article 10, in this case a cigarette, is depicted. The smoking article 10 includes a rod 20, such as a tobacco rod, and a mouth end filter 30. The filter 30 includes a mouth end segment 32, such as a white cellulose acetate tow segment, and an upstream carbon on tow segment 34. Filter segments 32 and 34 are shown as being separated for purposes of illustration, but may be abutting. Similarly, filter segment 34 and rod 20 are shown as being separated for purposes of illustration, but may be abutting. The depicted smoking article 10 includes plug wrap 60, cigarette paper 40, and tipping paper 50. In the depicted embodiment, the plug wrap 60 circumscribes at least a portion of the filter 30. The cigarette paper 40 circumscribes at least a portion of the rod 20. Tipping paper 50 or other suitable wrapper circumscribes the plug wrap 60 and a portion of the cigarette paper 40 as is generally known in the art.

FIG. 2 illustrates an embodiment where filter 30 is in a plug 32-space 37-plug 35 configuration. Activated carbon (not shown) may occupy the void space 37 between filter plugs 32 and 35. In FIG. 2, filter segment 35 and rod 20 are shown as being separated for purposes of illustration, but may be abutting. In FIG. 2 components labelled with the same number as components depicted in FIG. 1 are the same as, or similar to, those components as discussed with regard to FIG. 1 above. For those components not specifically discussed with regard to FIG. 2, reference is made to the discussion above with regard to FIG. 1.

Non-limiting examples illustrating activated carbon as described above and filters and smoking articles having such activated carbon are described below.

EXAMPLES

In the following examples, characterization of activated carbon produced from a variety of sources and the function of some of the activated carbon in filters of smoking articles is described.

The characterized activated carbon includes coconut shell-derived activated carbon activated to a BET of 1100 $m^2/g$ (GCN" REF), coconut shell-derived activated carbon activated to a BET of 1400 $m^2/g$ ("GCN EXTRA"), wood (pine) derived activated carbon activated to a BET of 1200 $m^2/g$ ("WOOD"), olive stone derived activated carbon activated to a BET of 1600 $m^2/g$ ("OLIVE STONE"), and extruded wood (wood=activatable binder) derived activated carbon activated to a BET of 1500 $m^2/g$ ("WOOD EXTRUDED").

GCN REF activated carbon was obtained from Cabot-Norit by steam activation. GCN EXTRA activated carbon was obtained from Cabot-Norit by steam activation. WOOD activated carbon was obtained from Cabot-Norit by steam activation. OLIVE STONE activated carbon was obtained from Cabot-Norit by chemical activation. WOOD EXTRUDED activated carbon was obtained from Cabot-Norit by steam activation after extrusion process.

Density, BET, mesh size or diameter, and ball-pan hardness for each of the activated carbon materials was tested or obtained from manufacturer specifications. Density was determined as follows. Briefly, density was determined according to ASTM D2854-09. BET was determined from using $N_2$ adsorption isotherm at −196° C. obtained in a volumetric Autosorb-6B apparatus from Quantachrome generally as described in the following (i) Gregg S J, Sing K S W. Adsorption, Surface Science and Porosity. Academic Press, New York 1982; and (ii) Rouquerol F, Rouquerol J, Sing K. Adsorption by powders and porous solids. Principles, methodology and applications. Academic Press, 1999; (iii) Linares-Solano A, Salinas-Martinez de Lecea C, Alcañiz-Monge J, Cazorla-Amorós D. Further advances in the characterization of Microporous carbons by Physical adsorption of gases. Tanso 1998; 185:316-25.

Ball-pan hardness was determined according to ASTM D3802-10.

The results of characterization of the activated carbon are presented in Table 1 below.

TABLE 1

Characterization of Activated Carbon

| Activated Carbon | Density ($g/cm^3$) | BET ($m^2/g$) | Mesh size (US) | Ball-pan Hardness (%) | Type |
|---|---|---|---|---|---|
| GCN REF | 0.49 | 1100 | 30 × 70 | 98 | Granules |
| GCN EXTRA | 0.39 | 1400 | 30 × 70 | 98 | Granules |
| WOOD | 0.35 | 1200 | 30 × 70 | 98 | Granules |
| WOOD EXTRUDED | 0.42 | 1500 | 0.8 mm diameter, length 2-4 mm | 99 | Cylinder |
| OLIVE STONE | 0.32 | 1600 | 30 × 70 | 75 | Granules |

Figure 3:
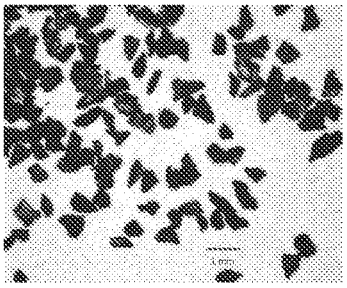
FIG. 3 is an example of representative images of activated carbon granules or cylinders.
Figure 3:
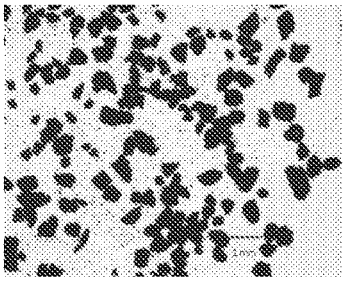
Figure 3:
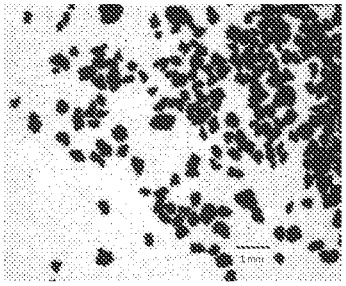
Figure 3:
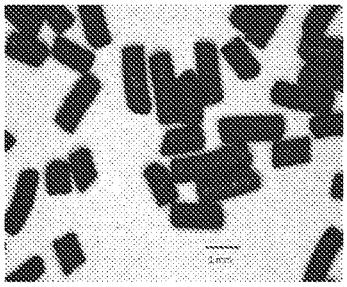
Figure 3:
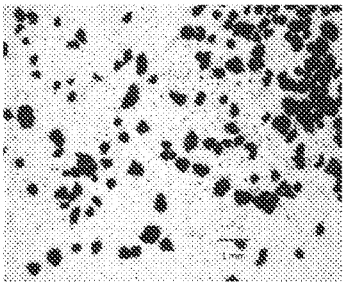

Representative images of activated carbon granules or cylinders used are shown in FIG. 3. As shown in FIG. 3, the relative amounts of dusting observed were as follows: OLIVE STONE≈GCN EXTRA>WOOD>GCN REF>>WOOD EXTRUDED.

Particle breakthrough and smoke constituent adsorption experiments were performed on filters of cigarettes, where the filters contained activated carbon. Activated carbon was incorporated into a void space of a filter in a plug-space-plug configuration or incorporated into a filter in a carbon on tow configuration. For the carbon on tow configuration, the filter contained a 7 mm mouth end section of white cellulose acetate tow abutted by a 20 mm cellulose acetate tow section into which 60 mg of activated carbon was incorporated. For the plug-space-plug configuration, the filter contained a 11 mm mouth end section of cellulose acetate tow and a 11 mm rod end section of cellulose acetate tow. The mouth end section and the rod end section were separated by a gap of 5 mm into the void space of which 110 mg of activated carbon was placed.

The filters containing activated carbon were incorporated into prototype cigarettes having a 57 mm long tobacco rod containing tobacco at about 700 mg. A control cigarette having a 27 mm cellulose acetate tow filter was also tested.

For particle breakthrough testing, the cigarettes were operably coupled to a smoking machine operably coupled to an AEROTRAK laser light scattering particle counter configured to detect particles in the size range of 0.3 micrometers to 10 micrometers. The cigarettes were dry puffed (unlit) by the machine for 12 puffs of 55 mL during 2 seconds every 13 seconds. Results were averaged for ten cigarettes for each tested filter construction.

For smoke constituent yields analysis, the cigarettes were tested according to (Coresta Methods) CRM N070 Determination of Selected Volatile Organic Compounds in the Mainstream Smoke of Cigarettes-Gas Chromatography-Mass Spectrometry Method and CRM No 74 Determination of Selected Carbonyls in Mainstream Cigarette Smoke by High Performance Liquid Chromatography (HPLC). Yields of acetaldehyde, acroleine, formaldehyde, benzene, and butadiene were evaluated.

Figure 4:
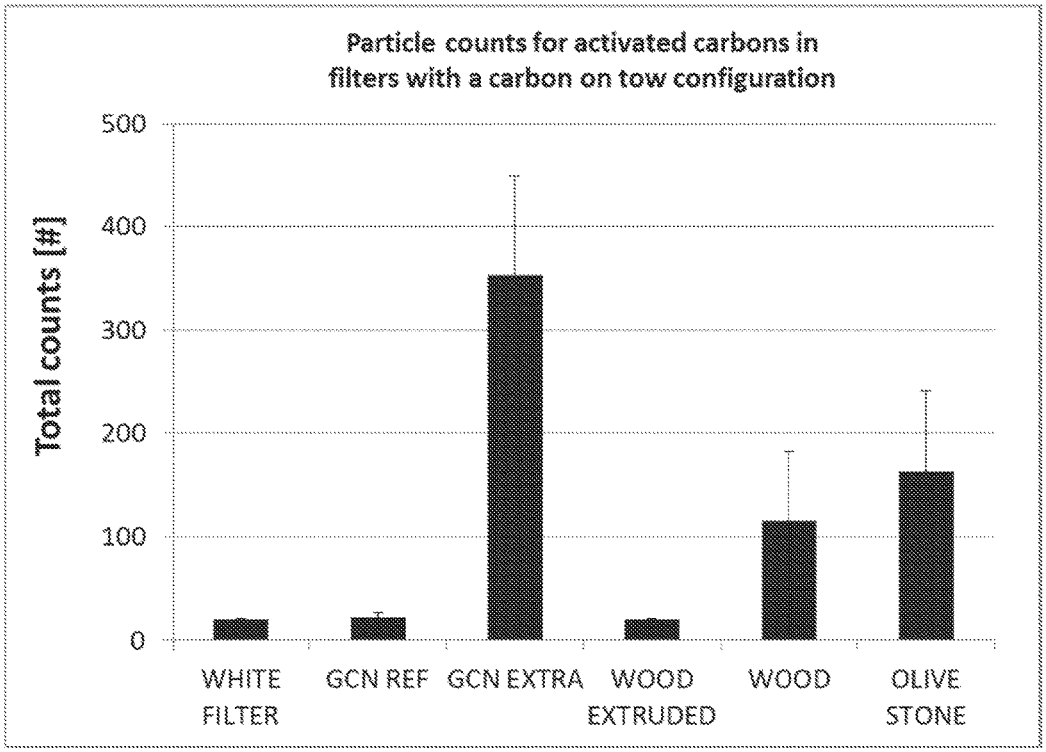
FIG. 4 illustrates example results of particle breakthrough experimentation associated with carbon on tow configurations.
Figure 5:
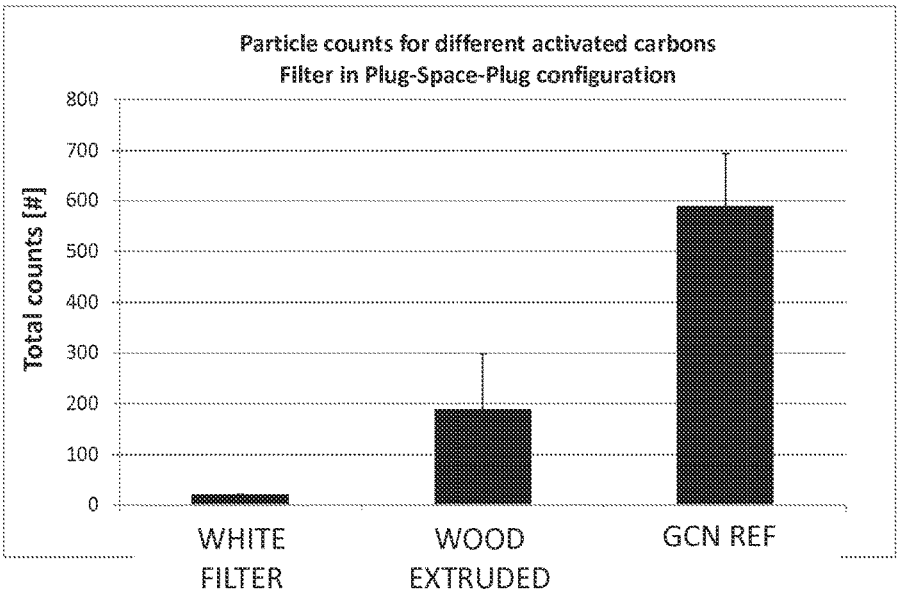
FIG. 5 illustrates example results of particle breakthrough experimentation associated with plug-space-plug configurations.

Results of the particle breakthrough experimentation are shown in FIGS. 4-5. In FIG. 4 results for carbon on tow configurations are shown. Particle counts for WOOD EXTRUDED were about equal to that of the reference white cellulose acetate filter (about 20 counts each), with GCN REF being slightly higher (about 22 counts). Particle counts for WOOD and OLIVE STONE were considerably higher with counts between 100 and 200. The more highly activated coconut shell-derived activated carbon (GCN EXTRA) was substantially higher than any other activated carbon tested with total particle counts of around 350. As shown in FIG. 4, filters having activated carbon derived from cellulosic material and a binder (WOOD EXTRUDED) exhibited less particle breakthrough than activated carbon currently used in smoking article filters (GCN REF) and substantially less than coconut shell-derived activated carbon activated to a similar degree (GCN EXTRA).

FIG. 5 shows particle breakthrough results for plug-space-plug configurations. As shown in FIG. 5, particle breakthrough tends to be higher in plug-space-plug filter configurations than in carbon on tow configurations. In the plug-space-plug configuration, particle breakthrough for the WOOD EXTRUDED activated carbon was higher than the control white filter, while no difference was seen between the two in the carbon on tow configuration. In the plug-space-plug configuration, WOOD EXTRUDED performed substantially better (less particle breakthrough) than GCN REF (about 190 vs. about 590, respectively).

Figure 6:
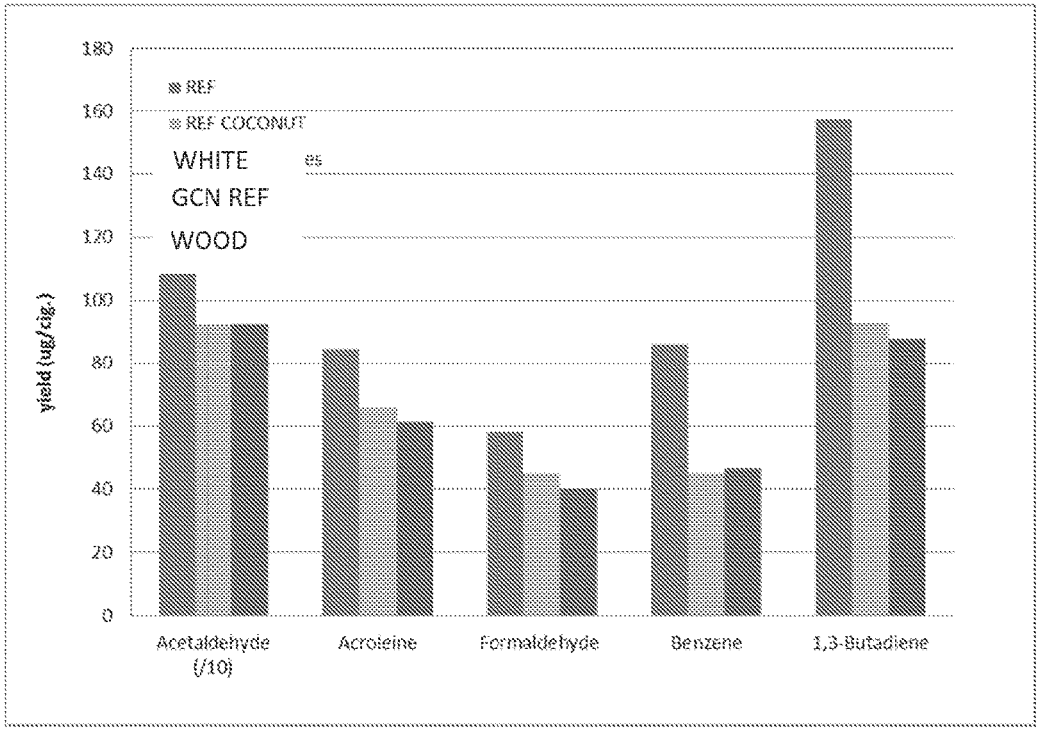
FIG. 6 is an example diagram illustrating an ability of GCN REF and WOOD activated carbon filters to adsorb various smoke constituents in a plug-space-plug configuration.
Figure 7:
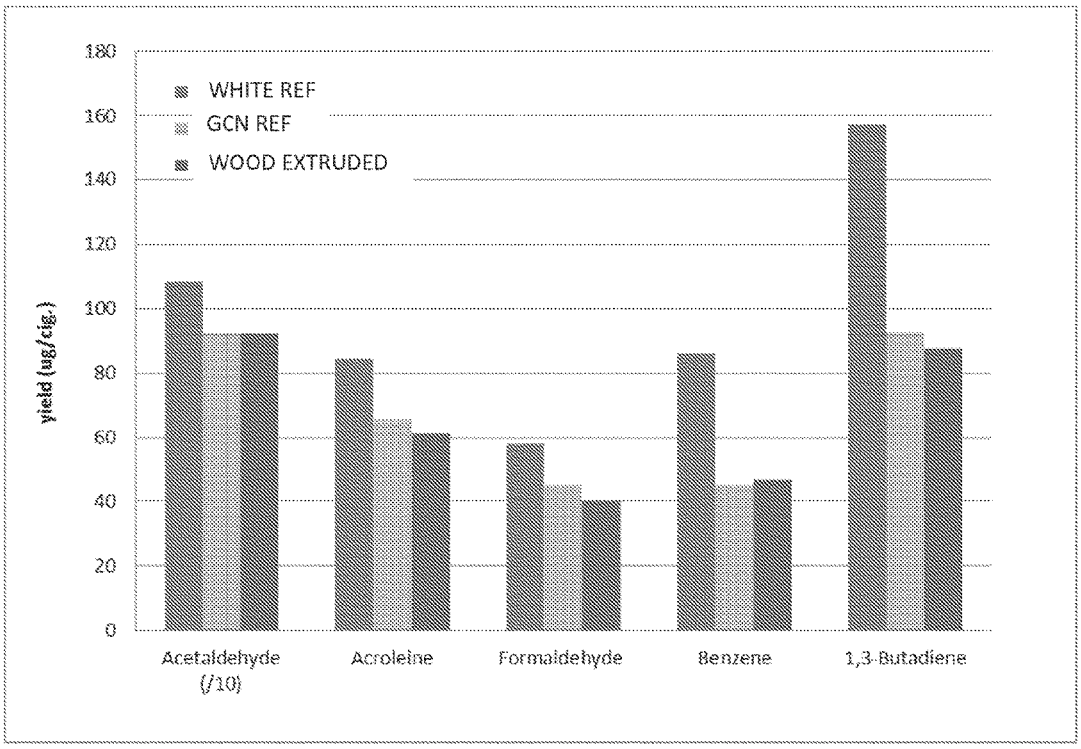
FIG. 7 is an example diagram illustrating an ability of GCN REF and WOOD EXTRUDED activated carbon filters to adsorb various smoke constituents in a carbon on tow configuration.

FIGS. 6-7 illustrate the ability of GCN REF and WOOD activated carbon filters to adsorb various smoke constituents in the plug-space-plug configuration (FIG. 6) and the ability of GCN REF and WOOD EXTRUDED activated carbon filters to adsorb various smoke constituents in the carbon on tow configuration (FIG. 7), relative to reference white cellulose acetate tow filters. As shown in both FIGS. 6 and 7, cigarettes having activated carbon in the filters were better able to reduce amounts of various smoke constituents than the filter without activated carbon (WHITE REF). FIGS. 6 and 7 also reveal that the WOOD EXTRUDED activated carbon performs about as well as the WOOD activated carbon. This can be derived because the WOOD in FIG. 6 performed about as well as the GCN REF in FIG. 6, and the WOOD EXTRUDED in FIG. 7 performed about as well as the GCN REF in FIG. 7. Accordingly the WOOD and WOOD EXTRUDED can be considered to perform similarly (as both perform similar to GCN REF). Accordingly, the presence of binder and extrusion does not appear to negatively affect the ability of WOOD EXTRUDED to adsorb smoke constituents.

The invention claimed is:

1. A method comprising:

physically activating a composition comprising cellulosic material and an added activatable binder to form an activated carbon material;

providing filter material for use in a smoking article; and combining the activated carbon material and the filter material to form a filter for a smoking article.

2. A method according to claim 1, further comprising incorporating the formed filter into a smoking article.

3. A method according to claim 1, wherein the activated carbon material is extruded activated carbon material.

4. A method according to claim 1, wherein the activatable binder comprises a lignin compound.

5. A method according to claim 4, wherein the cellulosic material comprises one or more of wood and olive stone.

6. A method comprising:

forming a filter of a smoking article by incorporating activated carbon material formed from a physical activation process that includes carbonizing a composition comprising cellulosic material and an added activatable binder.

7. A method according to claim 6, wherein the activated carbon material is extruded activated carbon material.

8. A method according to claim 6, wherein the activatable binder comprises a lignin compound.

9. A method according to claim 6, wherein the cellulosic material comprises one or more of wood and olive stone.

10. A smoking article comprising:

a smokable material; and a filter comprising activated carbon material downstream of the smokable material, the activated carbon material having a BET of between 1000 and 2000 $m^2/g$ and a ball-pan hardness of greater than about 95%;

wherein the activated carbon material is formed from a physical activation process that includes carbonizing a composition comprising cellulosic material and an added activatable binder; and wherein the activated carbon material exhibits, in a standard plug-space-plug configuration test filter, less particle breakthrough than granulated coconut shell activated carbon activated to the same degree.

11. A smoking article according to claim 10, wherein the activated carbon material has a BET from about 1200 $m^2/g$ to about 1800 $m^2/g$.

12. A smoking article according to claim 10, wherein the activated carbon material exhibits about 10% or more reduction in particle breakthrough than the granulated coconut shell activated carbon activated to the same degree.

13. A smoking article according to claim 10, wherein no coating or residue is disposed on the activated carbon material.

14. A smoking article according to claim 10, wherein the activated carbon material is extruded activated carbon material.

* * * * *